US010279881B2

(12) United States Patent
Matsuyama et al.

(10) Patent No.: US 10,279,881 B2
(45) Date of Patent: May 7, 2019

(54) STEERING HANDLE OF OUTBOARD MOTOR

(71) Applicant: SUZUKI MOTOR CORPORATION, Hamamatsu-shi, Shizuoka (JP)

(72) Inventors: Takeshi Matsuyama, Hamamatsu (JP); Masatoshi Kimpara, Hamamatsu (JP); Madoka Suzuki, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 15/970,572

(22) Filed: May 3, 2018

(65) Prior Publication Data

US 2018/0354596 A1 Dec. 13, 2018

(30) Foreign Application Priority Data

Jun. 12, 2017 (JP) ..... 2017-115217

(51) Int. Cl.

| | |
|---|---|
| ***B63H 20/00*** | (2006.01) |
| ***B63H 21/21*** | (2006.01) |
| ***F02D 11/04*** | (2006.01) |
| ***F02D 11/02*** | (2006.01) |
| ***F02B 61/04*** | (2006.01) |

(52) U.S. Cl.

CPC ..... *B63H 21/265* (2013.01); *B63H 21/213* (2013.01); *F02B 61/045* (2013.01); *F02D 11/02* (2013.01); *F02D 11/04* (2013.01)

(58) Field of Classification Search

CPC ..... B63H 21/265; B63H 21/213

See application file for complete search history.

(56) References Cited

U.S. PATENT DOCUMENTS

| | | | | |
|---|---|---|---|---|
| 3,503,360 | A * | 3/1970 | Hoff | B63H 21/28 192/96 |
| 5,545,064 | A * | 8/1996 | Tsunekawa | B63H 21/265 440/53 |
| 6,406,343 | B2 * | 6/2002 | Kawai | B63H 21/21 440/86 |
| 7,160,160 | B2 * | 1/2007 | Kojima | B63H 20/10 114/144 R |
| 7,442,104 | B2 * | 10/2008 | Okabe | B63H 20/08 440/53 |
| 7,553,206 | B2 * | 6/2009 | Hasegawa | B63H 20/00 440/84 |
| 9,896,176 | B2 * | 2/2018 | Suzuki | B63H 20/20 |

FOREIGN PATENT DOCUMENTS

| | | |
|---|---|---|
| JP | 7-81689 | 3/1995 |

* cited by examiner

*Primary Examiner* — S. Joseph Morano
*Assistant Examiner* — Jovon E Hayes
(74) *Attorney, Agent, or Firm* — Troutman Sanders LLP

(57) ABSTRACT

A tiller handle includes: a throttle shaft including first shaft and the second shaft; a conversion mechanism configured to convert rotation of the first shaft into a rectilinear motion of the throttle cable; an engagement pin provided in the second shaft; and a restriction member (shift arm) engaged with the engagement pin depending on a position of a selector in synchronization with the selector to restrict rotation of the second shaft in a throttle valve open direction. The first shaft and the second shaft are configured to relatively rotate each other only by a predetermined angle.

7 Claims, 6 Drawing Sheets

STEERING HANDLE OF OUTBOARD MOTOR

CROSS-REFERENCE TO RELATED APPLICATIONS

This application is based upon and claims the benefit of priority of the prior Japanese Patent Application No. 2017-115217, filed on Jun. 12, 2017, the entire contents of which are incorporated herein by reference.

BACKGROUND OF THE INVENTION

Field of the Invention

The present invention relates to a steering handle of an outboard motor provided with a throttle manipulator and a gearshift manipulator.

Description of the Related Art

In many cases, an outboard motor mounted on a ship has a steering handle for allowing an operator to perform steering. In addition, the steering handle is configured to allow a throttle manipulation or a gearshift manipulation in some cases.

For example, Patent Document 1 discusses a steering handle of an outboard motor provided with a throttle grip and a gearshift handle. If a throttle opening level increases while a gear position is neutral, that is, while an engine receives no load, an engine rotation number extremely increases, and this generates various problems. In order to avoid such problems, Patent Document 1 discusses a throttle opening level restriction mechanism for restricting a throttle manipulation while the gear position is neutral.

Patent Document 1: Japanese Laid-open Patent Publication No. 7-81689

In some cases, it is desirable to slightly open a throttle valve, for example, for a warm-up operation while the gear position is neutral. However, a throttle manipulation for the warm-up operation is also restricted by the throttle opening level restriction mechanism.

In the case of the throttle opening level restriction mechanism, if a throttle grip is rotated, for example, due to an erroneous manipulation or the like while the gear position is neutral, a distortion is generated in a throttle shaft connected to the throttle grip because it receives both a rotation force from the throttle grip and a restriction force from the throttle opening level restriction mechanism. If a distortion is generated in the throttle shaft, meshing accuracy of a gear that converts rotation of the throttle shaft into a rectilinear motion of a throttle cable is degraded. This may generate problems such as degradation of a subsequent steering feeling.

SUMMARY OF THE INVENTION

In view of the aforementioned problems, it is therefore an object of the present invention to allow a predetermined necessary throttle manipulation even when the gearshift manipulator is in the throttle manipulation restriction position by restricting a throttle manipulation depending on a position of the gearshift manipulator and to prevent degradation of a steering feeling.

According to an aspect of the present invention, there is provided a steering handle of an outboard motor, including: a throttle manipulator configured to perform a throttle manipulation for adjusting opening and closing a throttle valve; a gearshift manipulator configured to perform a gearshift manipulation for shifting a gear position of the outboard motor; a throttle shaft having a first shaft connected to the throttle manipulator to rotate around its center axis in response to a manipulation of the throttle manipulator and a second shaft arranged coaxially with the first shaft to rotate in synchronization with the first shaft; a conversion mechanism that converts rotation of the first shaft into a rectilinear motion of a throttle cable; an engagement portion provided in the second shaft; and a restriction member engaged with the engagement portion depending on a position of the gearshift manipulator in synchronization with the gearshift manipulator to restrict rotation of the second shaft in a throttle valve open direction, wherein the first shaft and the second shaft are configured to relatively rotate each other only by a predetermined angle.

DETAILED DESCRIPTION OF THE PREFERRED EMBODIMENTS

A steering handle of an outboard motor according to an embodiment of the invention includes a throttle manipulator configured to perform a throttle manipulation for adjusting opening and closing a throttle valve, a gearshift manipulator configured to perform a gearshift manipulation for shifting a gear position of the outboard motor, a throttle shaft having a first shaft connected to the throttle manipulator to rotate around its center axis in response to a manipulation of the throttle manipulator and a second shaft arranged coaxially with the first shaft to rotate in synchronization with the first shaft, a conversion mechanism that converts rotation of the first shaft into a rectilinear motion of a throttle cable, an engagement portion provided in the second shaft, and a restriction member engaged with the engagement portion depending on a position of the gearshift manipulator in synchronization with the gearshift manipulator to restrict rotation of the second shaft in a throttle valve open direction, wherein the first shaft and the second shaft are configured to relatively rotate each other only by a predetermined angle.

In the steering handle of the outboard motor configured as described above, even when the gearshift manipulator is in the throttle manipulation restriction position, the first shaft can rotate by manipulating the throttle manipulator in a throttle valve opening direction as long as the relative rotation between the first shaft and the second shaft is allowed. Since rotation of the first shaft is converted into a rectilinear motion of the throttle cable using the conversion mechanism, it is possible to open the throttle valve. Therefore, even when the gearshift manipulator is in the throttle manipulation restriction position by restricting the throttle manipulation depending on a position of the gearshift manipulator, it is possible to perform a predetermined necessary throttle manipulation (for example, a throttle manipulation for a warm-up operation) and prevent a distortion of the throttle shaft. Therefore, it is possible to prevent degradation of a steering feeling.

Embodiment

A preferable embodiment of the invention will now be described with reference to the accompanying drawings.

Figure 1:
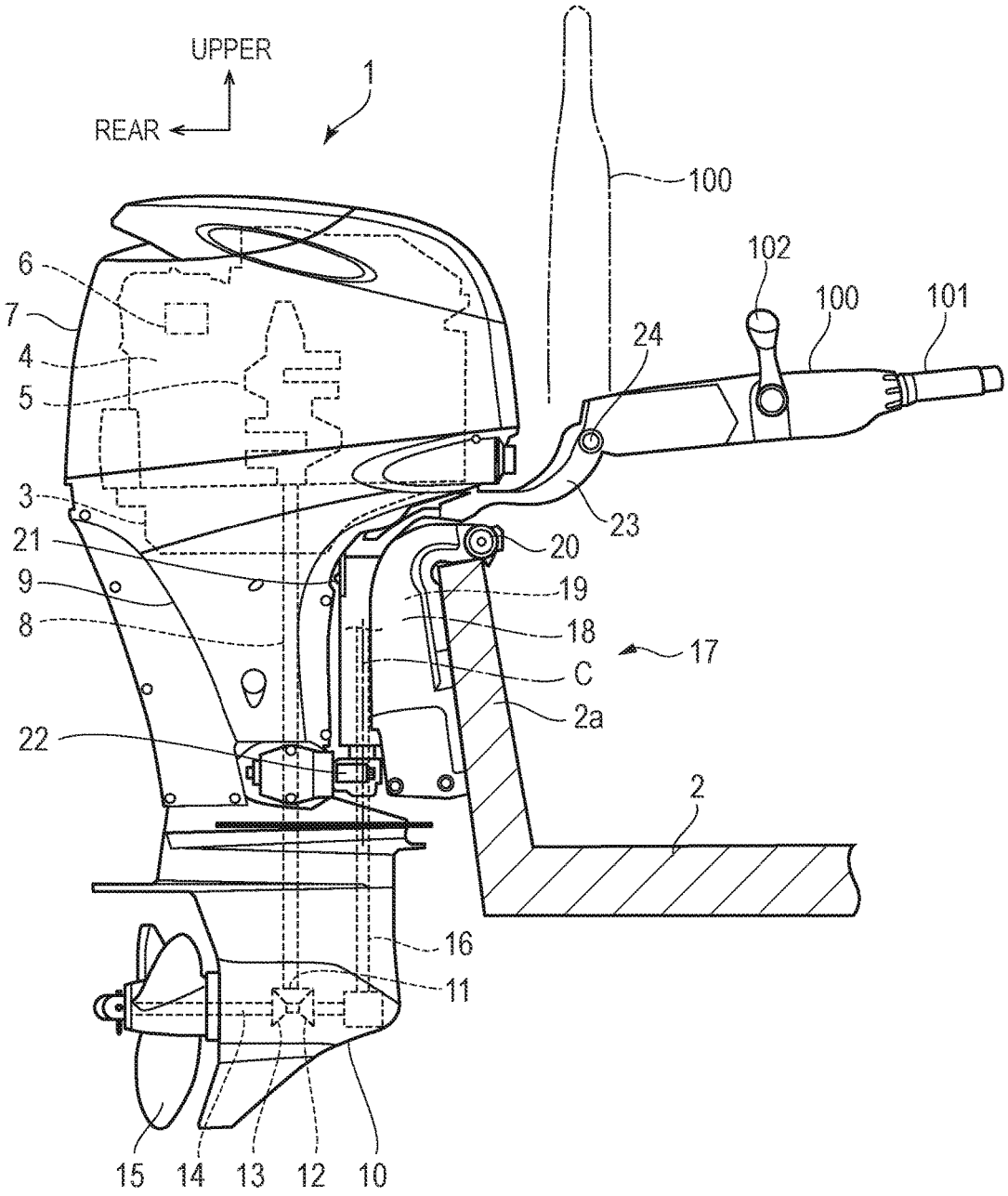
FIG. 1 is a right side view illustrating an outboard motor.

First, an exemplary outboard motor according to the invention will be described. FIG. 1 is a right side view illustrating the outboard motor 1. Herein, directions such as the upper, lower, left, right, front, and rear directions are illustrated by assuming that the outboard motor 1 is mounted on a ship hull 2, and they are referred to in each drawing as necessary.

The outboard motor 1 has an engine holder 3, and an engine 4 such as an internal combustion engine is mounted in the upper side of the engine holder 3. The engine 4 is, for example, a water-cooled four-cycle two-cylinder engine and also a vertical type engine in which its crankshaft 5 is arranged substantially vertically. An output power control of the engine 4 is performed by adjusting an intake air amount by opening or closing a throttle valve 6 or the like. The open/close adjustment of the throttle valve 6 is controlled using a throttle cable 105 described below in response to a manipulation of the throttle grip 101 of the tiller handle 100. The engine 4 is covered by an engine cover 7.

A drive shaft 8 vertically arranged is coupled to the lower end of the crankshaft 5. The drive shaft 8 is housed in a drive shaft housing 9 and extends to a gear casing 10 provided in a lower end of the drive shaft housing 9. A bevel gear 11, a front gear 12, a rear gear 13, and a propeller shaft 14 are arranged in the gear casing 10. The bevel gear 11 is coupled to a lower end of the drive shaft 8, and the front and rear gears 12 and 13 are arranged on an axis of the propeller shaft 14. Rotation of the drive shaft is transmitted from the bevel gear 11 to the propeller shaft 14 through the front or rear gear 12 or 13. A propeller 15 rotating in synchronization with the propeller shaft 14 is coupled to a rear end of the propeller shaft 14.

A shift rod 16 is arranged substantially vertically in front of the drive shaft housing 9. The shift rod 16 is actuated using a shift cable 110 described below in response to a manipulation on the selector 102 of the tiller handle 100. As the shift rod 16 is actuated, a gear position can be shifted to a forward or reverse position by switching a gear used to transmit power from the bevel gear 11 to the propeller shaft 14 between the front and rear gears 12 and 13 using a cam mechanism and a dog clutch (not shown) arranged in the gear casing 10.

The outboard motor is mounted on a transom board 2*a* of the ship hull 2 using a mount portion 17. The mount portion 17 has a pair of left and right clamp brackets 18 and a swivel bracket 19. The clamp brackets 18 are fixed to the transom board 2*a* in a tail end of the ship hull 2. The swivel bracket 19 is supported rotatably in a vertical direction by a tilt shaft 20 provided between a pair of left and right clamp brackets 18. A pilot shaft (not shown) is supported rotatably in a left-right direction by the swivel bracket 19. An upper mount bracket 21 and a lower mount bracket 22 are provided in upper and lower ends of the pilot shaft. The upper mount bracket 21 and the lower mount bracket 22 are coupled to the drive shaft housing 9.

The upper mount bracket 21 is provided with a handle bracket 23, and the tiller handle 100 is installed substantially along a horizontal direction by inserting a pivot shaft 24. The tiller handle 100 can be rotated around the pivot shaft 24 from a use state in which it extends to the front side substantially in the horizontal direction to a storage state in which it is erected substantially vertically (refer to the two-dotted chain line of FIG. 1).

The tiller handle 100 is used to allow an operator to change a steering angle of the outboard motor 1. As an operator turns the tiller handle 100 in the horizontal direction, the drive shaft housing turns with respect to an axial line C of the pilot shaft using the upper mount bracket 21 and the lower mount bracket 22. That is, the entire outboard motor turns in response to steering using the tiller handle 100 to change a travel direction of the ship hull 2.

The tiller handle 100 as a steering handle of the outboard motor will now be described in more details with reference to FIGS. 2 to 6B. Note that the directions described below refer to directions while the tiller handle 100 has a use state.

The tiller handle 100 is also called a bar handle and has a long handle body 103. The handle body 103 is formed of resin or the like, so that accessories can be mounted inside.

A throttle grip 101 is rotatably installed in one end of the handle body 103 (which is an end of a direction protruding from the outboard motor 1). The throttle grip 101 has a cylindrical shape extending in the front-rear direction in order to allow an operator to grip it easily, and is supported rotatably around its center line. The throttle grip 101 is a throttle manipulator for performing a throttle manipulation for adjusting an open/close operation of the throttle valve 6. Typically, the throttle grip 101 is set in a full-close position in which the throttle valve opening level is set to a minimum opening level. If the throttle grip 101 is rotated counterclockwise as seen from the ship hull 2 side, the throttle valve is manipulated in an open direction.

Figure 2:
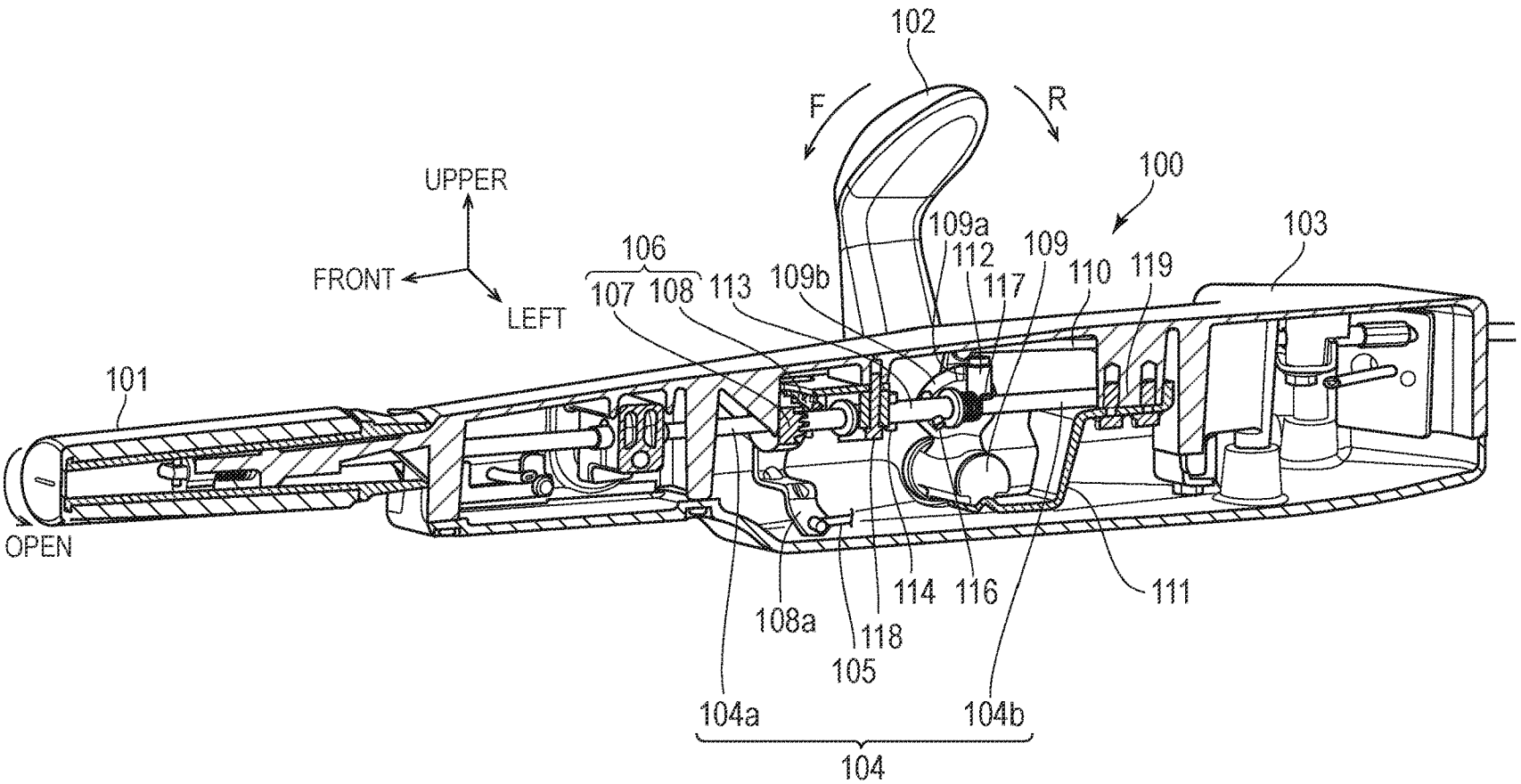
FIG. 2 is a cross-sectional view illustrating an internal structure of a tiller handle.
Figure 3:
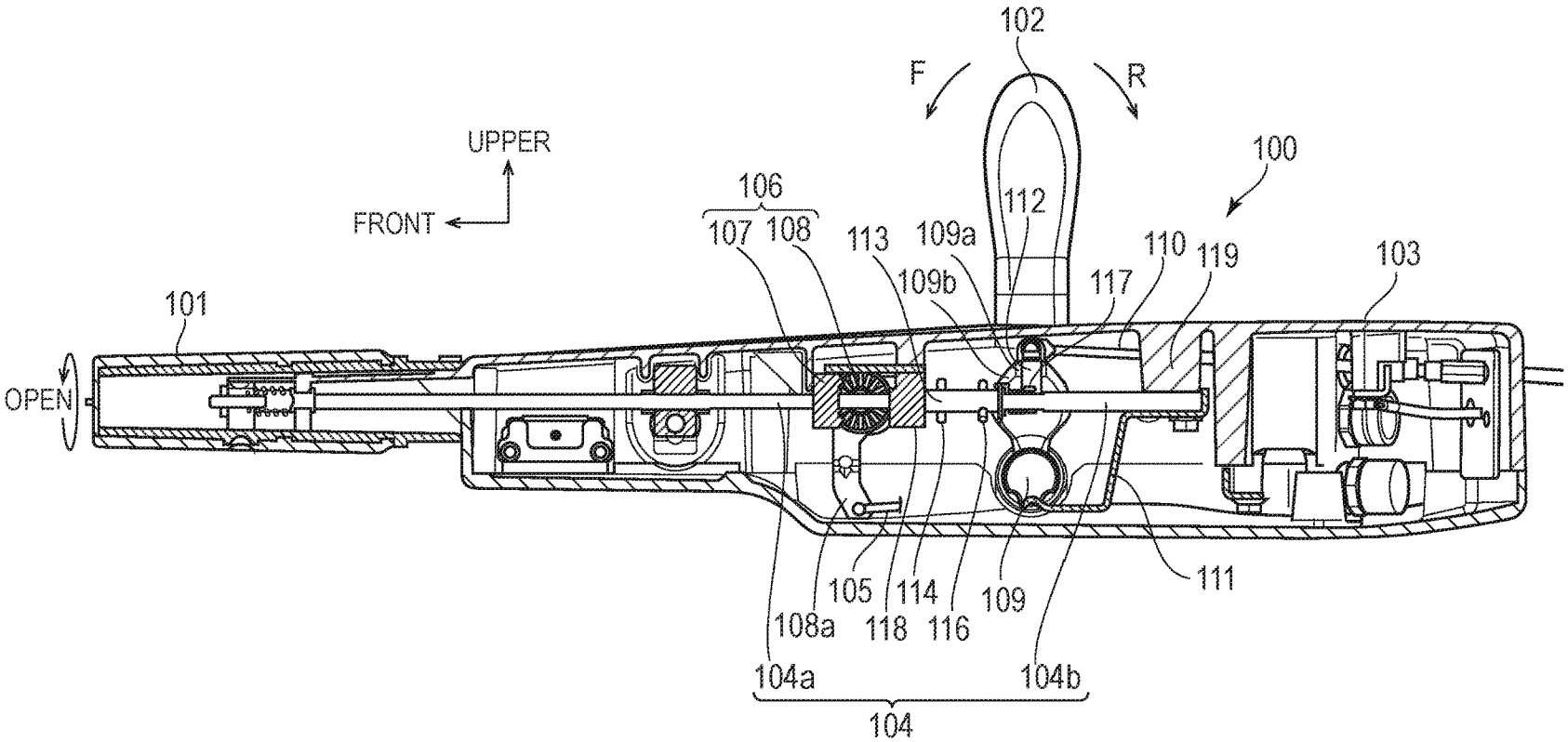
FIG. 3 is a cross-sectional view illustrating an internal structure of the tiller handle.

The selector 102 is installed in a substantially center of the front-rear direction on the right side surface of the handle body 103 tiltably to the front or rear direction. The selector 102 is a gearshift manipulator for performing a gearshift manipulation for shifting the gear position of the outboard motor 1. As illustrated in the arrow of FIG. 2, a gearshift manipulation to the forward position F is performed by tilting the selector 102 to the front direction from the neutral position. In addition, a gearshift manipulation to the reverse position R is performed by tilting it from the neutral position to the rear direction.

Inside the handle body 103, a throttle shaft 104 extending in the front-rear direction is connected to the throttle grip 101 and is arranged so as to rotate around its center axis in response to a manipulation of the throttle grip 101. The throttle shaft 104 includes a first shaft 104*a* connected to the throttle grip 101 so as to rotate around its center axis in response to a manipulation on the throttle grip 101, and a second shaft 104*b* arranged coaxially with the first shaft 104*a* so as to rotate along with the first shaft 104*a*.

A conversion mechanism 106 that converts rotation of the first shaft 104*a* into a rectilinear motion of the throttle cable 105 is linked to the first shaft 104*a*. The conversion mechanism 106 has a bevel gear 107 provided in the first shaft 104*a* and a gear 108 that is supported by the handle body 103 and meshes with the bevel gear 107. The throttle cable 105 is connected to an arm 108*a* extending downward from the gear 108. As the gear 108 is rotated through the bevel gear 107 in synchronization with rotation of the first shaft 104*a*, the arm 108*a* is tilted in the front or rear direction so that the throttle cable 105 makes a rectilinear motion (push-pull motion). The throttle cable 105 is mechanically linked to the throttle valve 6 of the outboard motor 1 so that the throttle valve 6 is adjusted for opening or closing in response to the push-pull motion. Any one of those well known in the art may be employed as this link mechanism, and it will not be described here for simplicity purposes.

Inside the handle body 103, a shift arm 109 tilted to the front or rear direction in synchronization with the selector 102 is arranged, and the shift cable 110 is connected to an upper part of the shift arm 109. As the shift arm 109 is tilted to the front or rear direction in synchronization with the selector 102, the shift cable 110 makes a rectilinear motion (push-pull motion). The shift cable 110 is mechanically linked to the shift rod 16 of the outboard motor 1, and the shift rod 16 is actuated in response to the push-pull motion of the shift cable 110. Any one of those well known in the art may be employed as this link mechanism, and it will not be described herein for simplicity purposes. Note that a detent mechanism 111 is provided under the shift arm 109 to hold forward, neutral, and reverse positions of the selector 102 and apply resistance to a gearshift manipulation.

Figure 4:
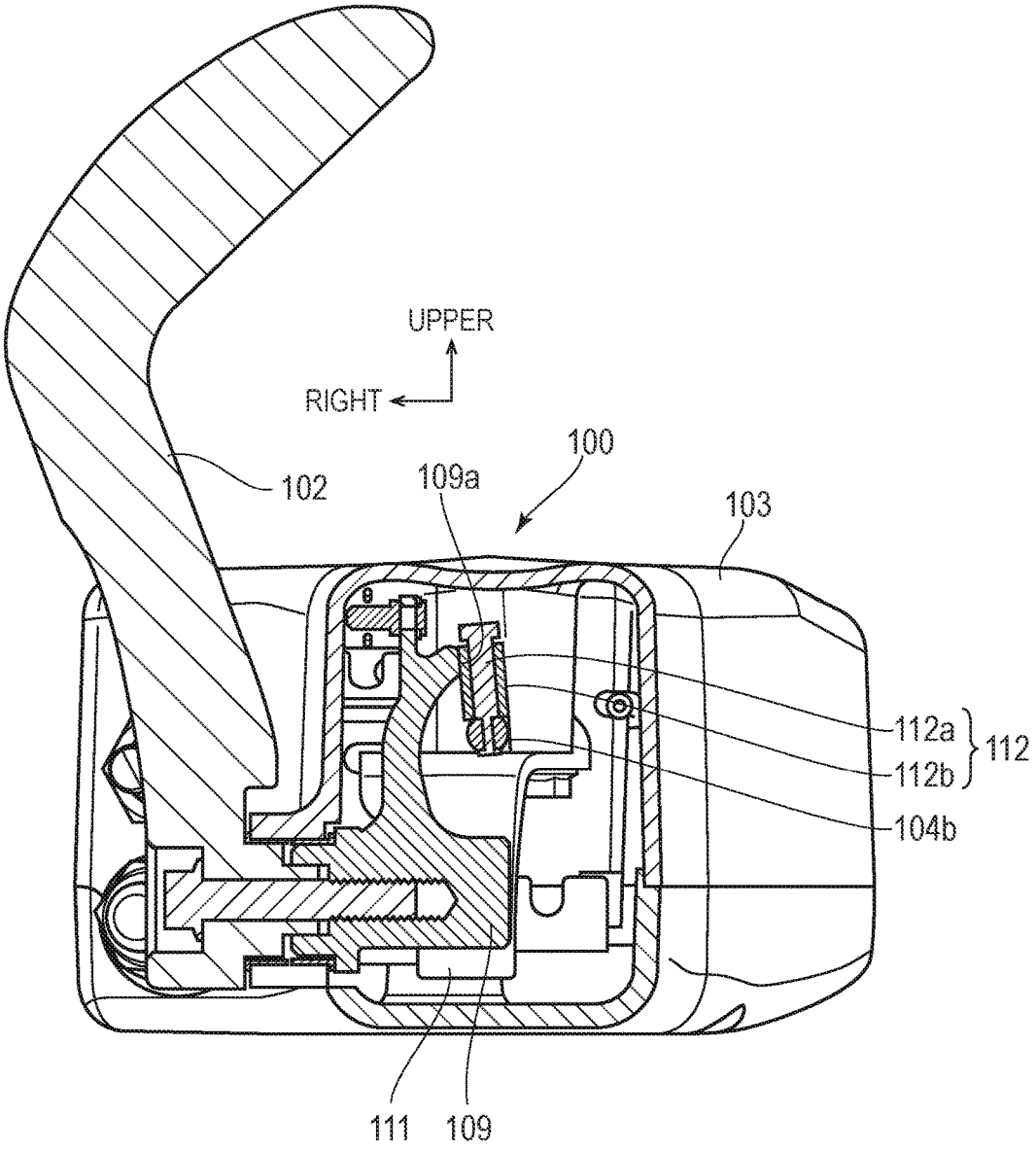
FIG. 4 is a cross-sectional view illustrating an internal structure of the tiller handle.

Here, the second shaft 104*b* is provided with an engagement pin 112 as the engagement portion. As illustrated in FIG. 4, the engagement pin 112 has a bar portion 112*a* provided in the second shaft 104*b* so as to protrude in a radial direction of the second shaft 104*b*, and a roller 112*b* rotatably installed in the bar portion 112*a*.

The shift arm 109 functions as a restriction member for restricting rotation of the second shaft 104*b* in the throttle valve open direction as it is engaged with the engagement pin 112 depending on a position of the selector 102.

Specifically, as illustrated in FIGS. 2 to 4 and 5A, when the shift arm 109 is in a neutral position in synchronization with the selector 102, the engagement pin 112 abuts on a restriction surface 109*a* of the shift arm 109 so as to restrict rotation of the second shaft 104*b* in the throttle valve open direction. As a result, a throttle manipulation for manipulating the throttle grip 101 in the throttle valve open direction is restricted.

Figure 5B:
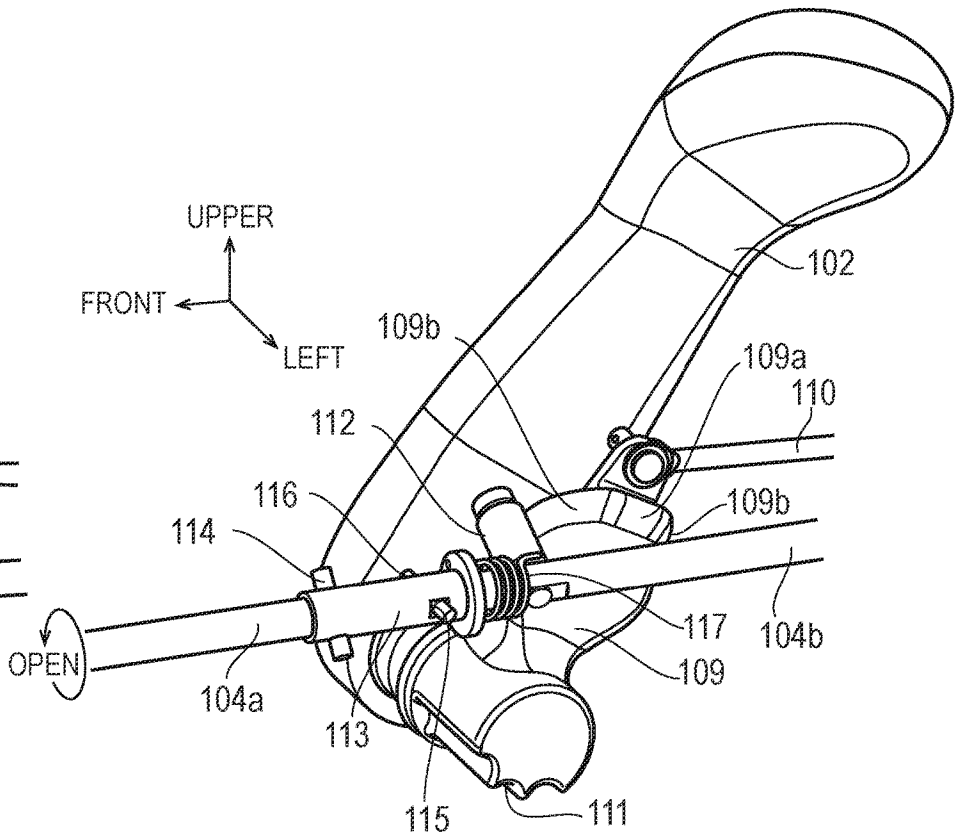
FIG. 5B is a perspective view illustrating an exemplary configuration of the surrounding structure of the selector.

Meanwhile, as illustrated in FIG. 5B, when the selector 102 is in a forward or reverse position, the shift arm 109 is tilted so that the restriction surface 109*a* deviates from the position of the engagement pin 112. Therefore, the second shaft 104*b* can rotate in the throttle valve open direction without a restriction. As a result, it is possible to freely manipulate the throttle grip 101 in the throttle valve open direction.

According to this embodiment, when the selector 102 is in the forward or reverse position, and the throttle grip 101 is manipulated in the throttle valve open direction over a predetermined manipulation range (a predetermined rotation angle from a full-close position), the engagement pin 112 is located in the lateral side of the shift arm 109. In this state, even when an operator tries to return the selector 102 to the neutral position, a gearshift manipulation for returning to the neutral position is restricted because the shift arm 109 interferes with the engagement pin 112. In other words, in order to return the selector 102 to the neutral position, it is necessary to first return the throttle grip 101 to the throttle valve close direction.

Figure 5A:
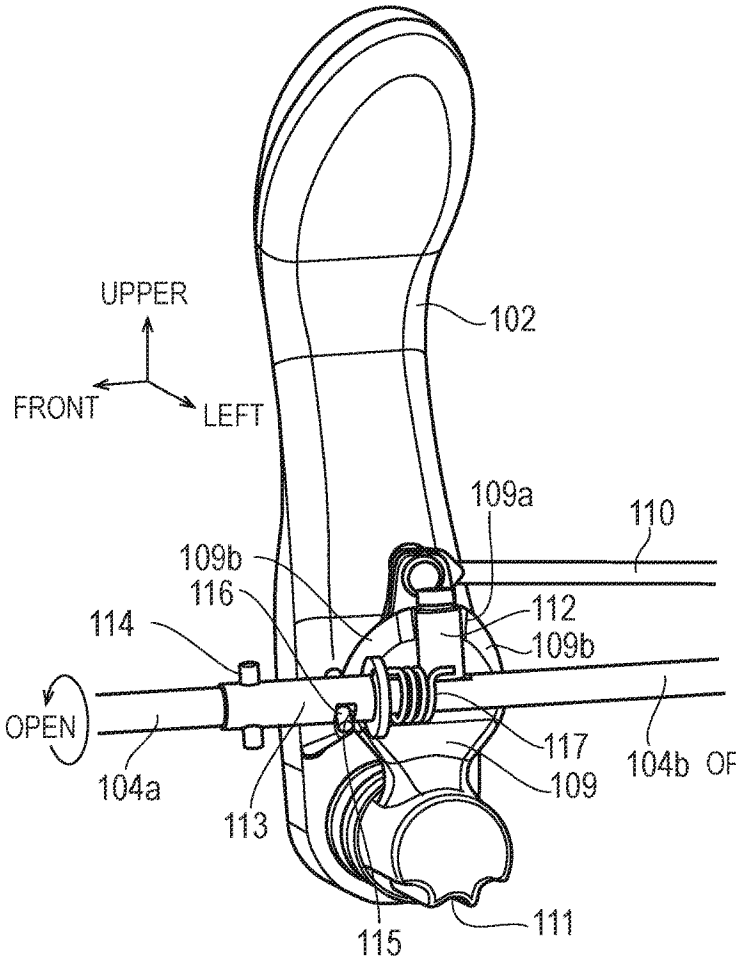
FIG. 5A is a perspective view illustrating an exemplary configuration of a surrounding structure of a selector.

According to this embodiment, when the selector 102 is in a forward or reverse position, and the throttle grip 101 is not greatly manipulated in the throttle valve open direction, the throttle grip 101 can forcibly return to the throttle valve close direction in synchronization with a gearshift manipulation for returning the selector 102 to the neutral position. Specifically, the shift arm 109 is provided with a guide surface 109*b* having a sloped surface shape continuous to both sides of the restriction surface 109*a* as a guide portion. When the selector 102 is in a forward or reverse position, and the throttle grip 101 is manipulated within a predetermined manipulation range (a predetermined rotation angle from the full-close position), the engagement pin 112 abuts on the guide surface 109*b* in response to a gearshift manipulation for returning the selector 102 to the neutral position. In addition, as the selector 102 returns to the neutral position, the engagement pin 112 is guided by the guide surface 109*b*, and the second shaft 104*b* is rotated in the throttle valve close direction. In this case, the roller 112*b* rolls on the guide surface 109*b*, so that it is possible to smoothly move the engagement pin 112 along the guide surface 109*b*. In addition, as the selector 102 returns to the neutral position, the engagement pin 112 returns to a state in which it abuts on the restriction surface 109*a* of the shift arm 109 as illustrated in FIG. 5A.

Figure 6A:
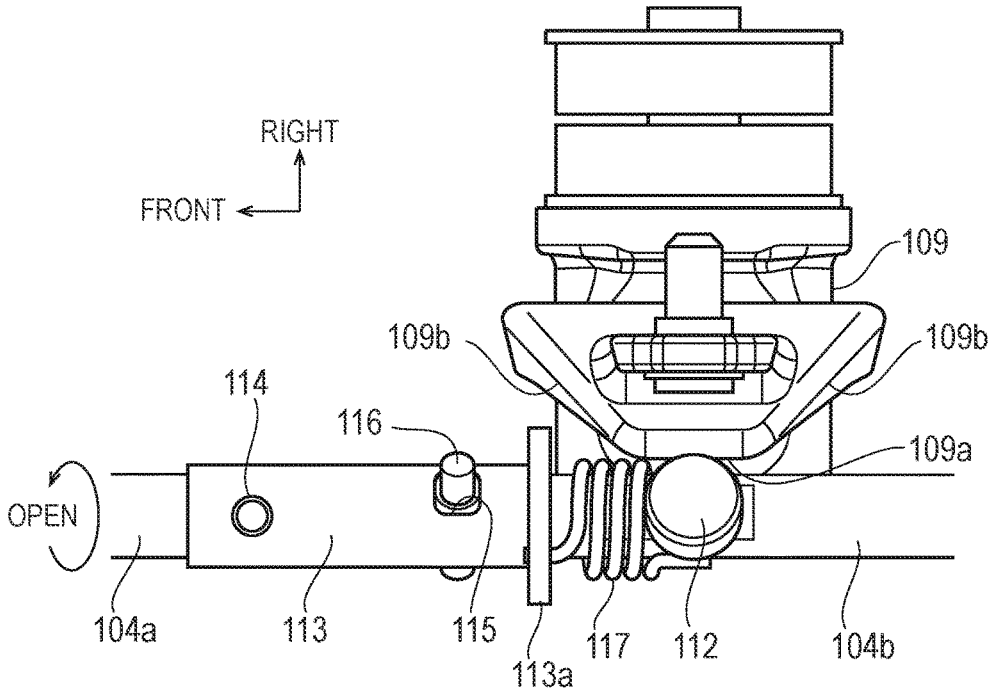
FIG. 6A is a plan view illustrating an exemplary configuration of a surrounding structure of a connecting portion between a first shaft and a second shaft.
Figure 6B:
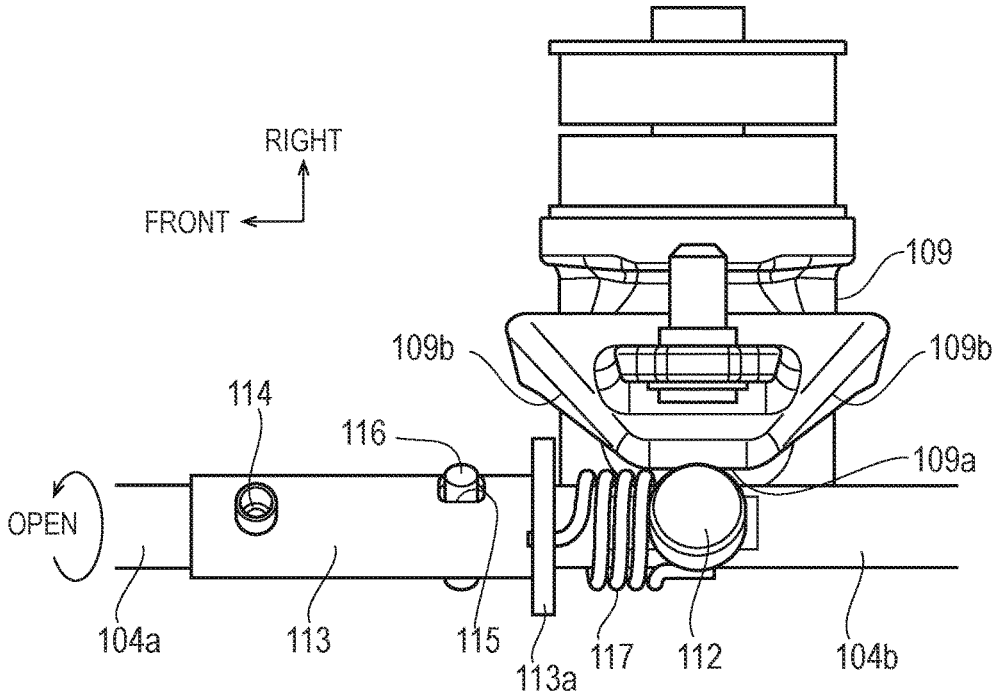
FIG. 6B is a plan view illustrating an exemplary configuration of the surrounding structure of the connecting portion between the first shaft and the second shaft.

FIGS. 6A and 6B illustrate an exemplary configuration of a surrounding structure of a connecting portion between the first shaft 104*a* and the second shaft 104*b*. As described above, the throttle shaft 104 includes the first shaft 104*a* and the second shaft 104*b*, and the first shaft 104*a* and the second shaft 104*b* are connected to each other through a cylindrical joint 113.

The first shaft 104*a* is inserted into one end of the joint 113, and the first shaft 104*a* and the joint 113 are fixed using the pin 114 to rotate in synchronization. Meanwhile, the second shaft 104*b* is inserted into the other end of the joint 113. The joint 113 is provided with an opening 115, and the pin 116 erected on the second shaft 104*b* is inserted into this opening 115. The opening 115 is set to be large in the rotation direction of the throttle shaft 104, compared to the pin 116. As a result, the second shaft 104*b* and the joint 113 (that is, the first shaft 104*a*) can relatively rotate until the pin 116 abuts on the edge of the opening 115.

A return spring 117 is provided as a biasing member for applying a biasing force to the first shaft 104*a* in the throttle valve close direction. The return spring 117 consists of a coil spring installed around the second shaft 104*b* and has one end linked to a flange 113*a* provided in the joint 113 and the other end locked with the engagement pin 112. By applying the biasing force to the first shaft 104*a* in the throttle valve close direction using the return spring 117, it is possible to maintain the throttle grip 101 in the full-close position using the first shaft 104*a* as illustrated in FIG. 6A and suppress wobbling between the first shaft 104*a* and the second shaft 104*b*.

As illustrated in FIGS. 1 and 2, inside the handle body 103, the throttle shaft 104 is rotatably supported by the bearings 118 and 119. Specifically, the first shaft 104*a* is rotatably supported by the bearing 118 in a portion closer to the second shaft 104*b*, compared to the bevel gear 107 of the conversion mechanism 106. In addition, the second shaft 104*b* is rotatably supported by the bearing 119 in a portion closer to the end of the outboard motor side (in a portion opposite to the throttle grip 101), compared to the engagement pin 112.

In the tiller handle 100 configured as described above, when the selector 102 is in the neutral position, the engagement pin 112 abuts on the restriction surface 109*a* of the shift arm 109 so as to restrict rotation of the second shaft 104*b* in the throttle valve open direction.

However, a throttle manipulation within a small throttle opening level is allowed even when the selector 102 is in the neutral position. Specifically, as illustrated in FIGS. 6A and 6B, the engagement pin 112 abuts on the restriction surface 109*a* of the shift arm 109, so that rotation of the second shaft 104*b* in the throttle valve open direction is restricted. However, the first shaft 104*a* and the second shaft 104*b* can relatively rotate only by a predetermined angle. Within this range, it is possible to rotate the first shaft 104*a* resisting to a biasing force of the return spring 117 by manipulating the throttle grip 101 in the throttle valve open direction. Since rotation of the first shaft 104*a* is converted into a rectilinear motion of the throttle cable 105 using the conversion mechanism 106, it is possible to open the throttle valve 6, for example, in order to perform a warm-up operation. Note that, when an operator releases a hand from the throttle grip 101, the throttle grip 101 returns to the full-close position by virtue of the biasing force of the return spring 117.

When the selector 102 is in the neutral position, and the throttle grip starts to rotate, for example, due to an erroneous manipulation or the like, the first shaft 104*a* and the second shaft 104*b* relatively rotate, so that it is possible to prevent a distortion of the throttle shaft 104. Therefore, it is possible to prevent degradation of meshing accuracy of the bevel gear 107 or the gear 108 included in the conversion mechanism 106 and degradation of a steering feeling.

While embodiments of the invention have been described in details hereinbefore with reference to the accompanying drawings, it should be noted that the aforementioned embodiments merely illustrate concrete examples of implementing the present invention, and the technical scope of the present invention is not to be construed in a restrictive manner by these embodiments. That is, the present invention may be implemented in various forms without departing from the technical spirit or main features thereof, and they are also included in the technical scope of the invention.

For example, although a push-pull type throttle manipulation and gearshift manipulation is performed by way of example in the aforementioned embodiment, for example, a pull-pull type may also be employed.

According to the present invention, it is possible to allow a predetermined necessary throttle manipulation even when the gearshift manipulator is in the throttle manipulation restriction position by restricting a throttle manipulation depending on a position of the gearshift manipulator and to prevent degradation of a steering feeling.

What is claimed is:

1. A steering handle of an outboard motor, comprising:

a throttle manipulator configured to perform a throttle manipulation for adjusting opening and closing a throttle valve;

a gearshift manipulator configured to perform a gearshift manipulation for shifting a gear position of the outboard motor;

a throttle shaft having a first shaft connected to the throttle manipulator to rotate around its center axis in response to a manipulation of the throttle manipulator and a second shaft arranged coaxially with the first shaft, the first shaft and the second shaft connected to each other through a joint to rotate in synchronization and configured to relatively rotate within a predetermined angle;

a conversion mechanism that converts rotation of the first shaft into a rectilinear motion of a throttle cable;

an engagement portion provided in the second shaft; and a restriction member engaged with the engagement portion depending on a position of the gearshift manipulator in synchronization with the gearshift manipulator to restrict rotation of the second shaft in a throttle valve open direction, wherein the first shaft and the second shaft are configured to perform the throttle manipulation within the predetermined angle even when the gearshift manipulator is in a throttle manipulation restriction position.

2. The steering handle of the outboard motor according to claim 1, further comprising a biasing member configured to apply a biasing force to the first shaft in a throttle valve close direction.

3. The steering handle of the outboard motor according to claim 1, wherein the engagement portion is engaged with the restriction member so as to restrict rotation of the second shaft in the throttle valve open direction when the gearshift manipulator is in a neutral position.

4. The steering handle of the outboard motor according to claim 3, wherein the restriction member interferes with the engagement portion so as to restrict a gearshift manipulation for returning the gearshift manipulator to the neutral position when the gearshift manipulator is in a forward position, or a reverse position, and the throttle manipulator is manipulated in the throttle valve open direction over a predetermined manipulation range.

5. The steering handle of the outboard motor according to claim 3, wherein the restriction member has a guide portion, and the guide portion rotates the second shaft through the engagement portion in the throttle valve close direction when the gearshift manipulator is in a forward or reverse position, the throttle manipulator is manipulated within a predetermined manipulation range, and a gearshift manipulation for returning the gearshift manipulator to the neutral position is performed.

6. The steering handle of the outboard motor according to claim 1, wherein the first shaft is provided with a gear included in the conversion mechanism, and the first shaft is rotatably supported by a bearing in a portion closer to the second shaft, compared to the gear.

7. The steering handle of the outboard motor according to claim 1, further comprising a shift arm actuated in response to a manipulation of the gearshift manipulator to make a rectilinear motion of a shift cable, wherein the shift arm functions as the restriction member.

* * * * *